US008438881B2

(12) United States Patent
Ihne et al.

(10) Patent No.: US 8,438,881 B2
(45) Date of Patent: May 14, 2013

(54) METHOD AND APPARATUS FOR DISPENSING TREATING CHEMISTRY IN A LAUNDRY TREATING APPLIANCE

(75) Inventors: Sarah Ihne, Stevensville, MI (US); Alvaro Vallejo Noriega, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 42 days.

(21) Appl. No.: 13/093,132

(22) Filed: Apr. 25, 2011

(65) Prior Publication Data

US 2012/0266389 A1 Oct. 25, 2012

(51) Int. Cl.
*D06F 39/02* (2006.01)

(52) U.S. Cl.
USPC ..... 68/17 R

(58) Field of Classification Search ..... 68/17 R, 68/207
See application file for complete search history.

(56) References Cited

U.S. PATENT DOCUMENTS

| | | | | |
|---|---|---|---|---|
| 4,489,574 | A * | 12/1984 | Spendel | 68/16 |
| 5,219,370 | A * | 6/1993 | Farrington et al. | 8/158 |
| 5,233,718 | A * | 8/1993 | Hardaway et al. | 8/158 |
| 5,249,441 | A * | 10/1993 | Pastryk et al. | 68/23.4 |
| 5,884,506 | A | 3/1999 | Blauert et al. | |
| 6,401,499 | B1 * | 6/2002 | Clark et al. | 68/17 R |
| 2009/0090141 | A1 * | 4/2009 | Deppermann et al. | 68/17 R |
| 2010/0000024 | A1 * | 1/2010 | Hendrickson et al. | 8/137 |
| 2010/0000025 | A1 * | 1/2010 | Dalton et al. | 8/137 |
| 2010/0000264 | A1 * | 1/2010 | Luckman et al. | 68/4 |
| 2010/0000265 | A1 * | 1/2010 | Hendrickson et al. | 68/12.18 |
| 2010/0000578 | A1 * | 1/2010 | Hendrickson et al. | 134/34 |
| 2010/0000581 | A1 | 1/2010 | Doyle et al. | |
| 2010/0000586 | A1 * | 1/2010 | Hendrickson | 134/56 D |
| 2010/0300157 | A1 | 12/2010 | Schulze | |
| 2012/0144878 | A1 * | 6/2012 | Acharya et al. | 68/17 R |

FOREIGN PATENT DOCUMENTS

| | | | |
|---|---|---|---|
| DE | 3908438 | A1 | 9/1990 |
| EP | 1884584 | A2 | 2/2008 |
| EP | 2003237 | A1 | 12/2008 |
| EP | 2141276 | A1 | 1/2010 |
| EP | 1997949 | B1 | 3/2010 |
| EP | 2104761 | B1 | 9/2010 |
| EP | 2241669 | A1 | 10/2010 |
| GB | 2104109 | A | 3/1983 |
| WO | 99/29953 | A1 | 6/1999 |

OTHER PUBLICATIONS

European Search Report for Corresponding EP 12163875.3, Aug. 27, 2012.

* cited by examiner

*Primary Examiner* — Joseph L Perrin
(74) *Attorney, Agent, or Firm* — Peter J. Melsa; Clifton G. Green

(57) ABSTRACT

A laundry treating appliance and method for dispensing treating chemistry, where the laundry treating appliance includes a treating chamber, a single use dispenser and a bulk dispenser. Water may be supplied to the single use dispenser through a first water flow path, which directs a dose of treating chemistry dispensed from the single use dispenser into the treating chamber. Water may be supplied to the bulk dispenser through a second water flow path, which is configured to spray a dose of treating chemistry dispensed from the bulk dispenser into the treating chamber. The laundry treating appliance may determine the presence of treating chemistry within at least one of the single use dispenser and the bulk dispenser, and, based on this determination, supply water to the flow path associated with the dispenser which contains treating chemistry.

11 Claims, 3 Drawing Sheets

METHOD AND APPARATUS FOR DISPENSING TREATING CHEMISTRY IN A LAUNDRY TREATING APPLIANCE

BACKGROUND OF THE INVENTION

Laundry treating appliances, such as clothes washers or clothes dryers, which include a treating chamber for receiving a laundry load, may implement a cycle of operation. Laundry treating appliances are often provided with a dispensing system for automatically dispensing one or more treating chemistries during a cycle of operation. One common type of dispenser is a manual or single use dispenser, which may be filled with a dose of treating chemistry sufficient for one cycle of operation and which typically dispenses the entire quantity of the treating chemistry during the cycle of operation. Another type of dispenser is a bulk dispenser, which may be filled with an amount of treating chemistry sufficient for multiple cleaning cycles and which typically dispenses a dose of treating chemistry sufficient for one cycle of operation during the cycle of operation. Some cleaning appliances have both a single use dispenser and a bulk dispenser. Treating chemistry can be dispensed for the purpose of treating a load of laundry within the treating chamber, or for treating the appliance itself, such as during a clean washer cycle or biofilm clean-out cycle, in which case the treating chamber is typically empty.

SUMMARY OF THE INVENTION

The invention relates to a laundry treating appliance and method for dispensing treating chemistry, where the laundry treating appliance includes a treating chamber, a single use dispenser and a bulk dispenser. Water is supplied to the single use dispenser through a first water flow path, and to the bulk dispenser though a second water flow path. The first water flow path is configured to direct a dose of treating chemistry dispensed from the single use dispenser into the treating chamber and the second water flow path is configured to spray a dose of treating chemistry dispensed from the bulk dispenser into the treating chamber.

DESCRIPTION OF EMBODIMENT(S) OF THE INVENTION

Figure 1:
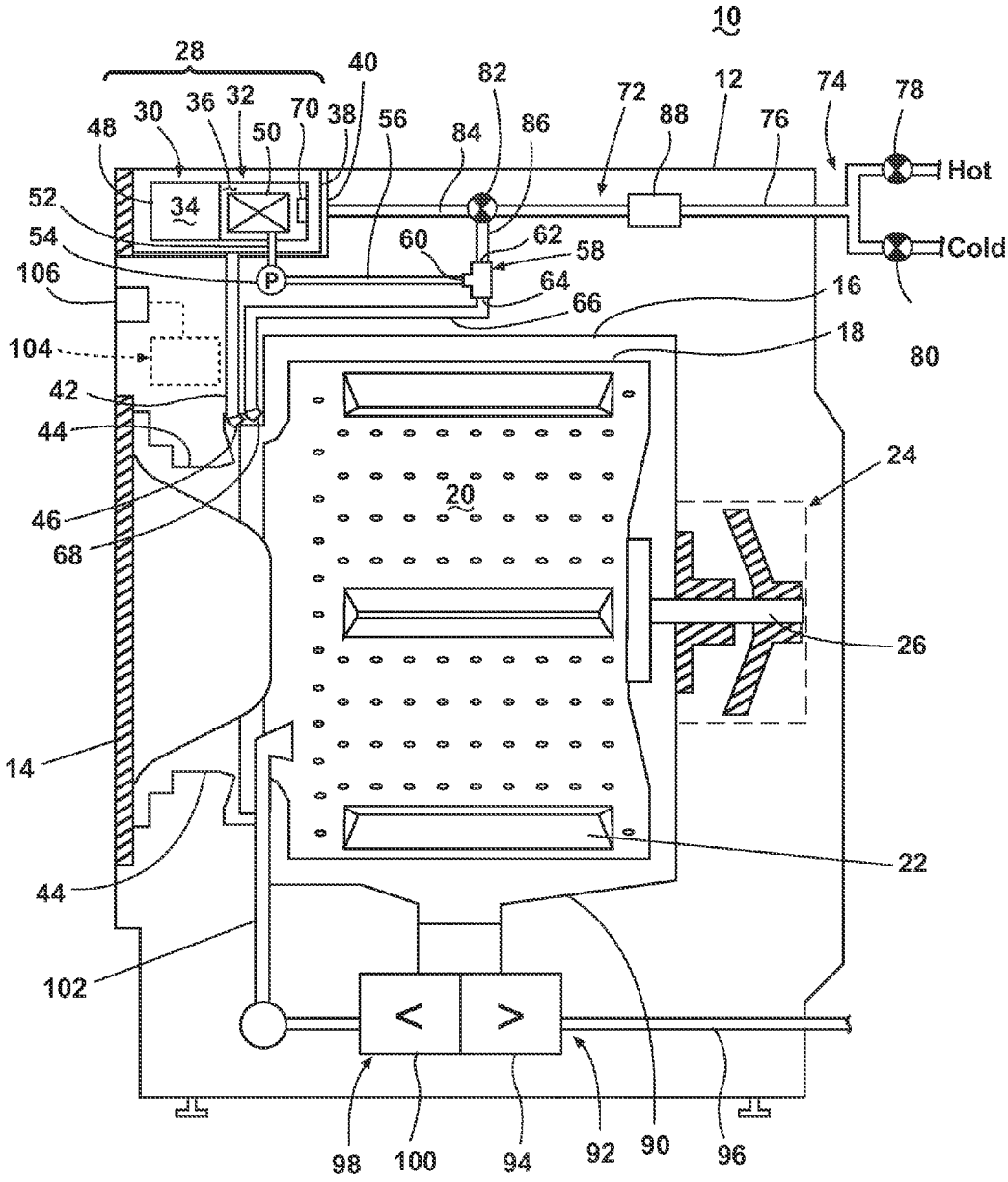
FIG. 1 is a schematic view of a laundry treating appliance in the form of a clothes washer according to an embodiment of the invention.

FIG. 1 is a schematic view of a laundry treating appliance in the form of a clothes washer 10 according to an embodiment of the invention. While the laundry treating appliance is illustrated as a horizontal axis clothes washer 10, the laundry treating appliance according to the invention may be any appliance which performs a cycle of operation on laundry, non-limiting examples of which include a vertical axis clothes washer; a combination washing machine and dryer; a tumbling or stationary refreshing/revitalizing machine; an extractor; a non-aqueous washing apparatus; and a revitalizing machine. The clothes washer 10 described herein shares many features of a traditional automatic clothes washer, which will not be described in detail except as necessary for a complete understanding of the invention. Although much of the remainder of this application will focus on the embodiment of an automatic clothes washer 10, the invention may have utility in other environments, including other cleaning appliances, especially in dishwashers.

The clothes washer 10 may include a cabinet 12, which may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

A door 14 may be mounted to the cabinet 12 to selectively close an access opening to the interior of liquid-holding, imperforate tub 16. The tub 16 may be supported within the cabinet 12 by a suitable suspension system (not shown). A drum 18 may be provided within the tub 16 and may have an inner periphery at least partially defining a treating chamber 20 for receiving fabric, such as laundry to be treated according to a cycle of operation. The drum 18 may be mounted for rotation within the tub 16 and may have perforations that permit the flow of liquid between the drum 18 and the tub 16.

The tub 16 and drum 18 may have aligned openings, which provide access to the treating chamber 20. The door 14 may be provided to selectively close at least one of the aligned openings to selectively provide access to the treating chamber 20. While the illustrated washing machine 10 includes both the tub 16 and the drum 18, with the drum 18 defining the treating chamber 20, it is within the scope of the invention for the clothes washer 10 to include only one receptacle, with the receptacle defining the treating chamber 20 for receiving the laundry load to be treated.

At least one lifter 22 may be provided in the drum 18 to facilitate movement of the laundry load within the drum 18 as the drum 18 rotates. The lifter 22 may be provided on the inner periphery of the drum 18. Multiple lifters 22 can be provided and can be evenly spaced about the inner periphery of the drum 18.

The drum 18 may be coupled with a motor 24 through a drive shaft 26 for selective rotation of the treating chamber 20 about a rotational axis during a cycle of operation. In the illustrated clothes washer 20, the drive shaft 26 may define the rotational axis. It may also be within the scope of the invention for the motor 24 to be coupled with the drive shaft 26 through a drive belt for selective rotation of the treating chamber 20. The motor 24 may rotate the drum 18 at multiple or variable speeds and in opposite rotational directions.

A dispensing system 28 may be provided within the cabinet 12 and may include a single use dispenser 30 and a bulk dispenser 32 configured to dispense treating chemistry into the treating chamber 20. The single use dispenser 30 may be configured to dispense a single charge or dose of treating chemistry, while the bulk dispenser 32 may be configured to dispense multiple charges or doses of treating chemistry. Examples of typical treating chemistries include, without limitation, bleach, water, detergent, fabric softener, and enzymes.

The dispensing system 28 may include multiple chambers, with at least one chamber 34 associated with the single use dispenser 30 for receiving a single dose of at least one treating chemistry, and at least one chamber 36 associated with the bulk dispenser 32 for receiving multiple doses of treating chemistry.

The chambers 34, 36 may be carried by a dispensing drawer 38 slidably received within the cabinet 12 or within a separate dispenser housing 40, as shown herein, which may be provided in the cabinet 12. The dispensing drawer 38 is moveable between a fill position, where the chambers 34, 36 are exterior to the cabinet 12 and may be filled with treating chemistry, and a dispense position, where the chambers 34, 36 are interior of the cabinet 12. Although the dispensing system 28 of FIG. 1 includes a dispenser drawer 38 and housing 40, the dispenser drawer 38 and housing 40 could be eliminated and replaced with a conduit.

The chamber 34 of the single use dispenser 30 may define a treating chemistry reservoir for receiving a single dose of at least one treating chemistry. While not shown, the single use dispenser 30 may include multiple chambers for receiving single doses of different treating chemistries. An outlet conduit 42 may fluidly couple the single use dispenser 30 with the tub 16. The outlet conduit 42 may couple with the tub 16 at any suitable location on the tub 16. The liquid that flows from the single use dispenser 30 through the outlet conduit 42 to the tub 16 may enter a space between the tub 16 and the drum 18. As shown, the outlet conduit 42 is coupled with a bellows 44 that couples an open face of the tub 16 with the cabinet 12 (the door 14 seals against the bellows 44 when the door 14 closes the tub 16 and drum 18). The outlet conduit 42 may comprise a dispensing nozzle 46 configured to dispense treating chemistry into the tub 16 in a desired pattern and under a predetermined amount of pressure. For example, the dispensing nozzle 46 may be configured to dispense a flow or stream of treating chemistry into the tub 16 by gravity, i.e. a non-pressurized stream. The dispensing nozzle 46 may be mounted to the bellows 44.

The chamber 34 may comprise a dispensing cup 48 that stores a single dose of treating chemistry, i.e., typically the entire volume of chemistry contained within the dispensing cup 48 is dispensed into the drum 16 during a single cycle of operation. The dispensing cup 48 may be provided on an exterior or interior of the cabinet 12 and may be immediately accessible by the user or hidden behind a cover, such as the drawer 38. At least a portion of the housing 40 and/or drawer 38 may underlie the dispensing cup 48, such that when the dispensing cup 48 overflows with liquid, the overflow passes to the housing 40 and/or drawer 38, and then to the outlet conduit 42. While not illustrated herein, the single use dispenser 30 may include multiple dispensing cups for different types of treating chemistry.

The chamber 36 of the bulk dispenser 32 may be configured to receive a cartridge 50 containing multiple doses of treating chemistry. The cartridge 50 may include an outlet 52 for dispensing the treating chemistry. The outlet 52 may be in fluid communication with a pump 54, which directs treating chemistry from the cartridge 50 into a transfer conduit 56. An in-line mixing chamber 58 is in fluid communication with the outlet side of the pump 54 via the transfer conduit 56. The in-line mixing chamber 58 has a first inlet 60 in communication with the transfer conduit 56 for receiving treating chemistry from the bulk dispenser 32, a second inlet 62 in communication with a source of water for receiving water, and an outlet 64 in fluid communication with an outlet conduit 66 for outputting a mixture of treating chemistry and water. As shown herein, the pump 54 and the in-line mixing chamber 58 may be exterior of the housing of the dispensing system 28; alternatively, one or both of the pump 54 and in-line mixing chamber 58 may be provided within the housing 40. In another example, the pump 54 may be integrated with the cartridge 50 in a refillable or disposable unit.

The outlet conduit 66 may fluidly couple the in-line mixing chamber 58 with the tub 16. The outlet conduit 66 may couple with the tub 16 at any suitable location on the tub 16. The liquid that flows from the bulk dispenser 32 through the outlet conduit 66 to the tub 16 may enter a space between the tub 16 and the drum 18. A shown, the outlet conduit 66 is coupled with the bellows 44 on the tub 16. The outlet conduit 66 may comprise a spray nozzle 68 configured to dispense liquid into the tub 16 in a desired pattern. For example, the spray nozzle 68 may be configured to spray a pressurized flow of liquid into the tub 16. The spray nozzle 68 may be mounted to the bellows 44.

The dispensing system 28 may further include at least one sensor 70 for determining the presence of treating chemistry in one or both of the single use dispenser 30 and the bulk dispenser 32. As shown herein, a sensor 70 is provided on the bulk dispenser 32 for determining the presence of treating chemistry in the bulk dispenser 32. More specifically, the sensor 70 can be configured to determine the presence of the cartridge 50 within the housing 40. The sensor 70 can further be configured to detect the level of detergent in the cartridge 50. Alternatively, separate sensors can be provided for determining the presence of the cartridge 50 within the housing 40 and for detecting the level of detergent in the cartridge 50. Alternatively, the sensor 70 can be provided on the single use dispenser 30 for determining the presence of treating chemistry in the single use dispenser 30, such as by being configured to detect a predetermined minimum weight of treating chemistry in the single use dispenser 30. Illustrative examples of the sensor include a pressure switch, proximity switch, optical sensor, and magnetic sensor.

A liquid supply system 72 may also be included in the clothes washer 10 to supply liquid to both the dispensing system 28 and/or the tub 16. The liquid supply system defines two water flow paths: a first flow path that flows through the housing 40 and a second flow path that bypasses the housing 40, yet is still fluidly coupled to the bulk dispenser 32. With this structure, the first and second flow paths may be independently controlled, including the manner in which the corresponding fluid is introduced into the treating chamber 20. More specifically, liquid such as water may be supplied from a water source, such as a household water supply 74, to the clothes washer 10 by operation of at least one control valve controlling the flow of water through an inlet conduit 76. As shown herein, separate valves 78, 80 controlling hot and cold water, respectively, through the inlet conduit 76 may be provided. A diverter mechanism 82, such as a diverter valve, may fluidly couple with the inlet conduit 76 and may have two outlets such that the diverter mechanism 82 may selectively direct a flow of liquid through a first supply conduit 84 leading to the housing 40 or through a second supply conduit 86 leading to the in-line mixing chamber 58, thereby, bypassing the housing 40. A flow meter 88 may be positioned in the inlet conduit 76 and may have any suitable output representative of the flow of water through it.

The path of liquid through the first supply conduit 84 may define at least a portion of the first water flow path through the clothes washer 10. Specifically, the first water flow path may extend from the diverter mechanism 82, through the first supply conduit 84, and through the housing 40 containing the single use dispenser 30, such that water flowing through the first flow path can flush treating chemistry out of the dispensing cup 48 and into the outlet conduit 42. The mixture of water and treating chemistry can then flow into the tub 16 via the dispensing nozzle 46, which may form an outlet of the first water flow path.

The path of liquid through the second supply conduit 86 may define at least a portion of the second water flow path through the clothes washer 10. Specifically, the second water flow path may extend from the diverter mechanism 82, through the second supply conduit 86, through the in-line mixing chamber 58, and into the tub 16 via the spray nozzle 68, which may form an outlet of the second water flow path. As such, the second water flow path may bypass the housing 40.

The first and second flow paths can be completely separate. Alternatively, at least a portion of both the first and second flow paths may extend through the treating chemistry dispenser 30 as well. However, in this case, the second flow path does not extend through the housing 40 or single use dispenser 30, such that treating chemistry stored within the single use dispenser 30 is not taken up by water flowing along the second flow path.

Liquid in the treating chamber 20 may flow by gravity to a low portion or sump 90 of the tub 16. A liquid drain system 92 may be provided for draining liquid from the treating chamber 20. The liquid drain system 92 may include a drain pump 94 and a drain conduit 96. The drain pump 94 fluidly couples the sump 90 to the drain conduit 96 such that liquid in the tub 16 may be drained via the drain conduit 96. The drain conduit 96 may be coupled with a household drain (not shown).

A liquid recirculation system 98 may be provided for recirculating liquid to the treating chamber 20. As illustrated, the recirculation system 98 includes a recirculation pump 10 and a spray conduit 102. The recirculation pump 100 may fluidly couple the tub 16 to the spray conduit 102 such that liquid in the tub 16 may be supplied to the spray conduit 102, where it may be sprayed into the treating chamber 20. The recirculation pump 100 may be fluidly coupled to the sump 90 of the tub 16. The spray conduit 102 may direct the liquid from the recirculation pump 100 into the drum 18 in any suitable manner, such as by spraying, dripping, or providing a steady flow of the liquid. While the clothes washer 10 is illustrated as having separate drain and recirculation pumps 94, 100 in an alternative embodiment, the clothes washer 10 may include a single pump configured to selectively drain or recirculate liquid, such as by configuring the pump to rotate in opposite directions, or by providing a suitable valve system.

The clothes washer 10 may further include one or more devices for heating the liquid such as a steam generator and/or a sump heater (not shown). The steam generator may be provided to supply steam to the treating chamber 20. The sump heater may be used to heat liquid in the sump 60. Alternatively, the sump heater may be used to heat laundry (not shown), air, the drum 18, or liquid in the tub 16 to generate steam, in place of or in addition to the steam generator. The steam generator may be used to heat to the laundry as part of a cycle of operation, much in the same manner as sump heater, as well as to introduce steam to treat the laundry.

A controller 104 may be located within the cabinet 12 for controlling the operation of the clothes washer to implement one or more cycles of operation, which may be stored in a memory of the controller 104. Examples, without limitation, of cycles of operation include: wash, heavy duty wash, delicate wash, quick wash, refresh, rinse only, and timed wash. A user interface 106 that is operably coupled to the controller 104 may also be included on the cabinet 12 and may include one or more knobs, switches, displays, and the like for communicating with the user, such as to receive input and provide output. The user may enter many different types of information, including, without limitation, cycle selection and cycle parameters, such as cycle options.

During operation of the clothes washer 10, the controller 104 may be operably coupled with one or more components of the clothes washer 10 for communicating with and controlling the operation of the component to complete a cycle of operation. For example, the controller 104 may be operably coupled with at least the motor 24, the pump 54, the sensor 70, the valves 78, 80, diverter mechanism 82, the flow meter 88, the drain pump 94, and the recirculation pump 100 to control the operation of these and other components to implement one or more of the cycles of operation.

Figure 2:
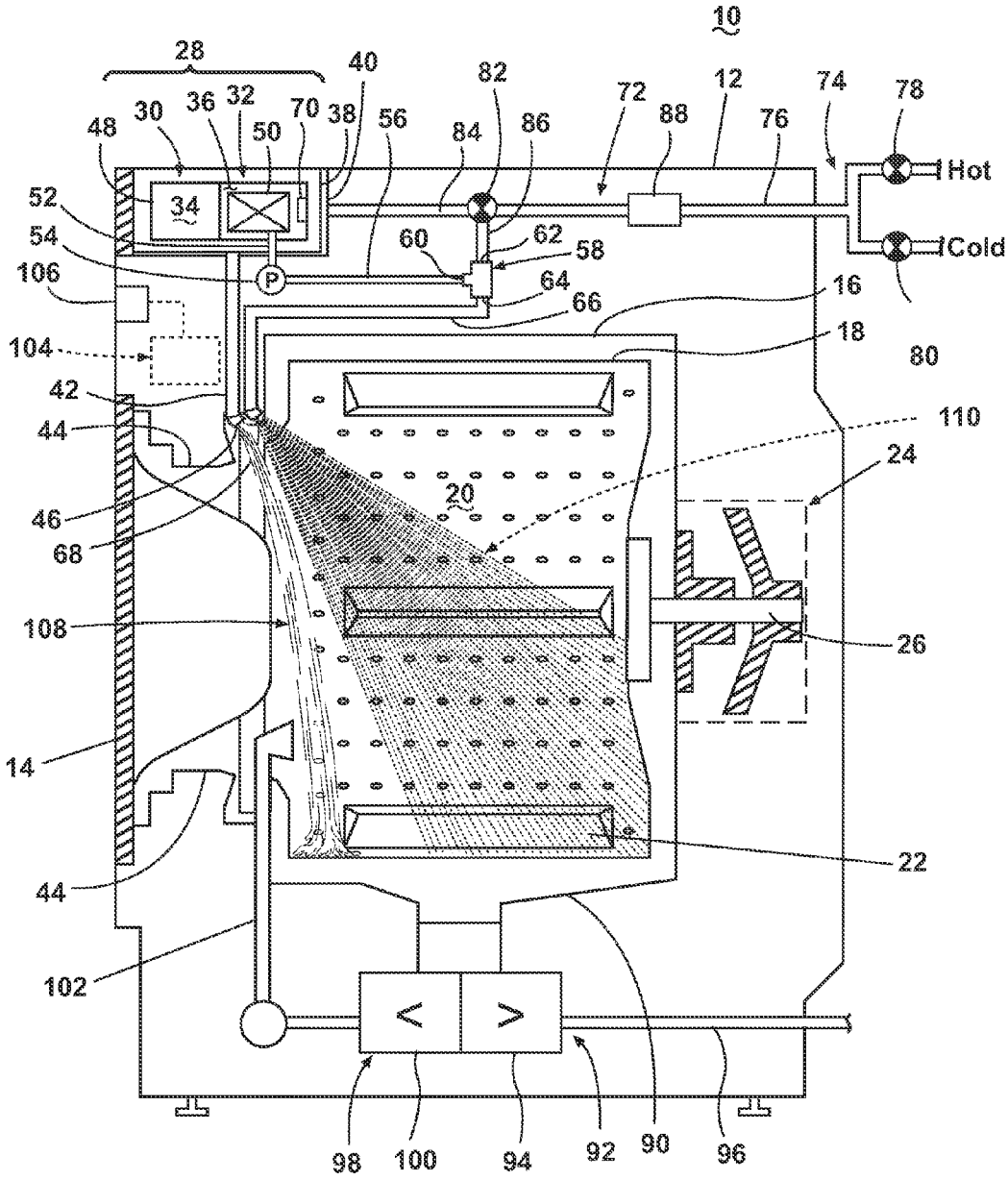
FIG. 2 is a schematic view similar to FIG. 1, illustrating a comparison of a coverage pattern of a spray nozzle and a dispensing nozzle of the clothes washer from FIG. 1.

FIG. 2 is a schematic view similar to FIG. 1, illustrating a comparison of a coverage pattern of the dispensing nozzle 46 and the spray nozzle 68. The dispensing nozzle 46 and the spray nozzle 68 can be configured to have different patterns of coverage. For example, the dispensing nozzle 46 can be configured to emit a flow or stream of liquid in a first predetermined coverage pattern 108 that covers less than 5% of the lower half of the treating chamber 20, wherein the lower half of the treating chamber 20 is defined as the portion of the treating chamber 20 below a horizontal plane passing through the rotational axis of the treating chamber 20. In contrast, the spray nozzle 68 can be configured to emit droplets of water in a second predetermined coverage pattern 110 that covers at least 50% of the lower half of the treating chamber 20. The second predetermine coverage pattern 110 can further cover at least a portion of the upper half of the treating chamber 20. The second predetermined coverage pattern 110 may have a cone-like shape extending from the spray nozzle 68, while the first predetermined coverage pattern 108 may have a narrower column-like shape extending from the dispensing nozzle 46.

The previously described clothes washer 10 provides the structure necessary for the implementation of a method of the invention. One embodiment of the method of the invention will now be described in terms of the operation of the clothes washer 10.

Figure 3:
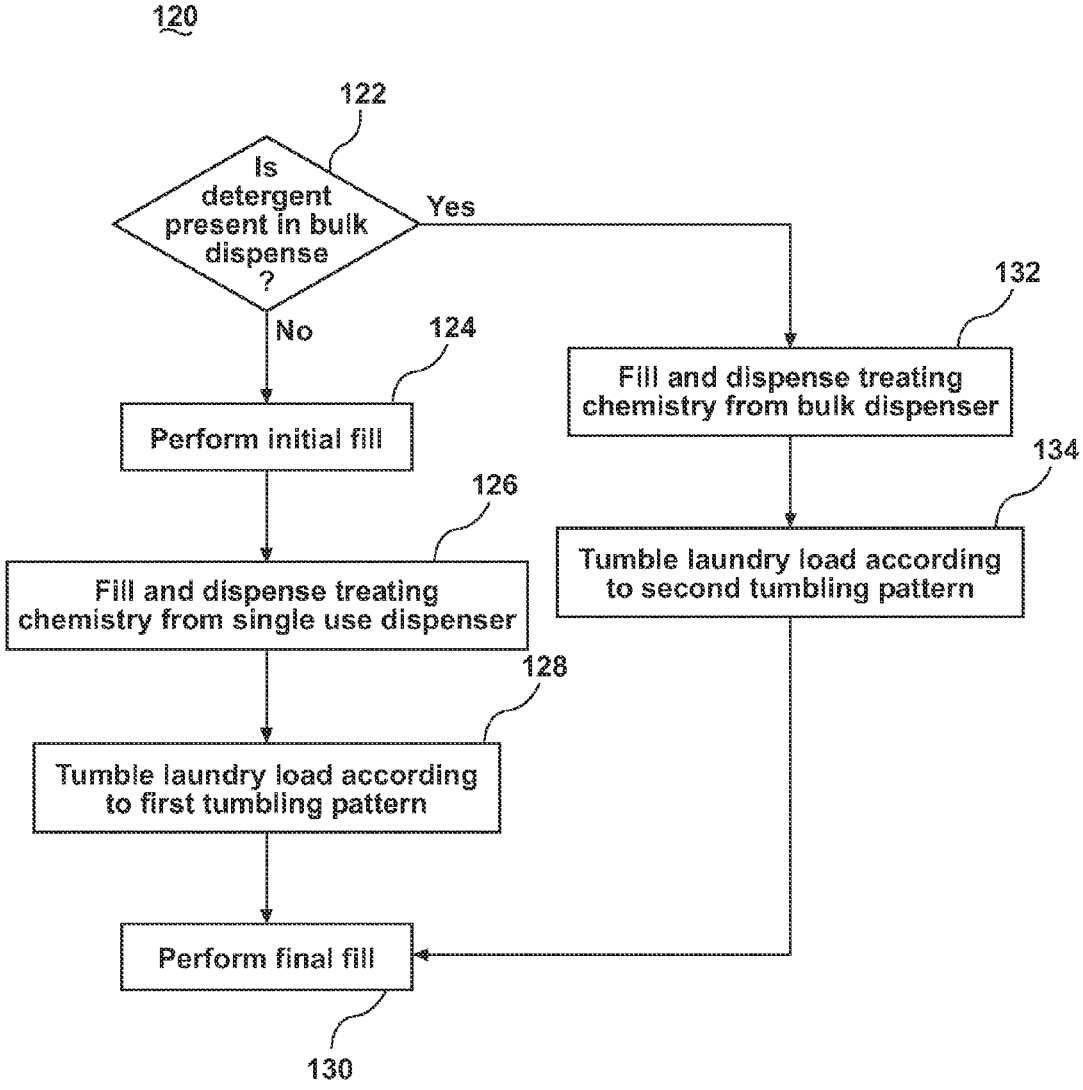
FIG. 3 is flowchart illustrating a method of operating the clothes washer from FIG. 1, including dispensing treating chemistry.

FIG. 3 is flowchart illustrating a method 120 of operating a clothes washer, described in reference to the clothes washer 10 of FIGS. 1-2. Specifically, the method 120 dispenses treating chemistry into the treating chamber 20. The method 120 can be carried out as part of a cycle of operation of the clothes washer 10. Specifically, the method 120 may be part of a filling phase of the cycle of operation, in which the tub 16 is filled with liquid comprising water and treating chemistry to an operational level, which is the level of liquid sufficient to tumble a laundry load during a wash phase of the cycle of operation. As described herein, the method 120 may begin under the assumption that a user has placed a load of laundry into the treating chamber 20, and that treating chemistry is present in at least one of the single use dispenser 30 and the bulk dispenser 32. However, the method 120 may also be carried out as part of a treatment cycle for the clothes washer 10 itself, such as during a clean washer cycle or biofilm clean-out cycle. In this case, the treating chamber 20 is typically empty, i.e. no load of laundry is present in the treating chamber 20.

The method 120 can first begin with a step 122 of determining whether treating chemistry is present in the bulk dispenser 32. This may be accomplished by detecting the presence or absence of treating chemistry in the bulk dispenser 32; both means can be treated as one and the same for purposes of the method 120. As illustrated in the flowchart of FIG. 3, step 122 may include determining if the cartridge 50 is present in the chamber 36 of the bulk dispenser 32. The sensor 70 may be configured to detect the presence of the cartridge 50, and communicate information regarding the presence or absence of the cartridge 50 to the controller 104. The sensor 70 may further be configured to detect the level of detergent in the cartridge 50, and communicate information regarding the level of detergent in the cartridge 50 to the controller 104.

While the method 120 is described with reference to determining if treating chemistry is present in the bulk dispenser 32, it is within the scope of the invention of the method 120 to alternatively determine whether treating chemistry is present in the single use dispenser 30 solely, or in combination with, determining if treating chemistry is present in the bulk dispenser 32.

If treating chemistry is determined to be absent in the bulk dispenser 32, the method 120 moves on to step 124, under the assumption that treating chemistry is present in the single use dispenser 30. If treating chemistry is determined to be present in the bulk dispenser 32, the method 120 moves on to step 132, described below.

Step 124 may be an initial fill step, which may entail spraying water into the treating chamber 20 to at least partially fill the tub 16. The spray at step 124 may also be configured to evenly wet the laundry load. The amount of water sprayed can be an amount that will just wet the load, an amount that will saturate the load, or an amount greater than the amount required to saturate the load, and may be less than the operational level. In one example, the amount of water sprayed in step 124 can be approximately 1.5 liters. Alternatively, the amount can vary, based on a selected parameter or a selected cycle of operation. For example, the amount of water sprayed at step 124 can be based on a cycle time or a load quantity. To spray water alone, the second flow path can be activated by positioning the diverter mechanism 82 in communication with the in-line mixing chamber 58 and by opening at least one of the valves 78, 80. Since the second flow path bypasses the single use dispenser 30 and includes the spray nozzle 68, water without treating chemistry can be sprayed into the treating chamber 20 under pressure.

During the initial fill at step 124, the treating chamber 20 can be rotated to tumble the laundry load to distribute the sprayed water throughout the laundry load. The treating chamber 20 can be rotated by activating the motor 24, which turns the drum 18 defining the treating chamber 20. The treating chamber 20 can be continuously rotated, or can be intermittently rotated. For an intermittent rotation, the treating chamber 20 can be rotated in a rotation pattern defined by multiple rotation phases in which the motor 24 is active, separated by non-rotational phases in which the motor 24 is inactive. Likewise, water can be continuously sprayed while the treating chamber 20 is rotated, or can be intermittently sprayed. In one example, where both the rotation of the treating chamber 20 and the spraying of water occur intermittently, water may be sprayed only during the non-rotational phases.

Next, treating chemistry is applied to the wetted laundry load from the single use dispenser 30 at step 126, which also continues to fill the tub 16. The treating chemistry may comprise a solution of water and treating chemistry stored in the dispensing cup 48. The solution of water and treating chemistry can be formed by activating the first flow path by positioning the diverter mechanism 82 in communication with the first supply conduit 84 and by opening at least one of the valves 78, 80. The position of the diverter mechanism 82 may be controlled based information from the sensor 70. This permits water to mix with the treating chemistry stored in the dispensing cup 48, resulting in the formation of the solution. Specifically, water entering the housing 40 flushes treating chemistry in the dispensing cup 48 into the treating chamber 20 via the outlet conduit 42. Since the first flow path includes the dispensing nozzle 46, the solution can flow into the treating chamber 20 by gravity.

Next, the laundry load can be tumbled in the treating chamber 20 at step 128 in accordance with a first tumbling pattern to distribute the treating chemistry throughout the laundry load. The laundry load can be tumbled by activating the motor 24, which turns the drum 18 defining the treating chamber 20. The first tumbling pattern can include continuation or intermittent rotation. For an intermittent rotation, the first tumbling pattern can be defined by multiple rotation phases in which the motor 24 is active, separated by non-rotational phases in which the motor 24 is inactive. The first tumbling pattern used during step 128 may be different than the rotation pattern during water spraying to wet the load at step 124, or may be the same. Tumbling the laundry load at step 128 may occur after all treating chemistry has been dispensed at step 126. Alternatively, steps 126 and 128 may at least partially overlap, such that the treating chemistry can be continuously or intermittently applied while the treating chamber 20 is rotated.

Finally, at step 130, a final fill step commences, which may entail spraying additional water into the treating chamber 20 to fill the tub 16 to the operational level. To spray water alone, the second flow path can be activated by positioning the diverter mechanism 82 in communication with the in-line mixing chamber 58 and by opening at least one of the valves 78, 80. Since the second flow path bypasses the single use dispenser 30 and includes the spray nozzle 68, water without treating chemistry can be sprayed into the treating chamber 20 under pressure. During the final fill at step 130, the treating chamber 20 can be rotated to tumble the laundry load to distribute the sprayed water throughout the laundry load, as described above with respect to the initial fill step 124.

Predetermined amounts of water can be dispensed to the laundry load during steps 124, 126 and 128. The predetermined amount can be based on the desired operational liquid level, wherein the operational liquid level is approximately equal to the total amount of liquid applied during steps 124, 126, and 128. The total amount can be preset, or can vary based on a selected parameter or a selected cycle of operation. For example, the total amount of liquid applied at steps 124, 126, and 128 can be based on a cycle time or a load quantity.

Turning back to step 122, if treating chemistry is determined to be present in the bulk dispenser 32 at step 102, the method 120 moves on to step 132. In step 132, treating chemistry is applied to the unwetted laundry load from the bulk dispenser 32; thus, the initial filling of the tub 16 and chemistry dispensing to the treating chamber 20 are performed simultaneously. The treating chemistry may comprise a solution of water and treating chemistry stored in the cartridge 50. The solution of water and treating chemistry can be formed within the in-line mixing chamber 58. Treating chemistry stored in the cartridge 50 can be dispensed to the in-line mixing chamber 58 by activating the pump 54, which may be configured to dispense a single charge or dose of treating chemistry to the in-line mixing chamber 58 via the transfer conduit 56. Water can be supplied by the in-line mixing chamber 58 by activating the second flow path, which entails positioning the diverter mechanism 82 in communication with the in-line mixing chamber 58 and opening at least one of the valves 78, 80. The position of the diverter mechanism 82 may be controlled based on information from the sensor 70. This permits the water to mix with the treating chemistry in the in-line mixing chamber 58, resulting in the formation of the solution. The solution exits the in-line mixing chamber 58 via the outlet 64 and into the outlet conduit 66. Since the second flow path includes the spray nozzle 68, the solution can be sprayed into the treating chamber 20 under pressure.

Next, the laundry load can be tumbled in the treating chamber 20 at step 132 in accordance with a second tumbling pattern to distribute the treating chemistry throughout the laundry load. The laundry load can be tumbled by activating the motor 24, which turns the drum 18 defining the treating chamber 20. The second tumbling pattern can include continuation or intermittent rotation. For an intermittent rotation, the second tumbling pattern can be defined by multiple rotation phases in which the motor 24 is active, separated by non-rotational phases in which the motor 24 is inactive. Tumbling the laundry load at step 134 may occur after all treating chemistry has been dispensed at step 132. Alternatively, steps 132 and 134 may at least partially overlap, such that the treating chemistry can be continuously or intermittently applied while the treating chamber 20 is rotated. Finally, the method 120 proceeds to step 130, in which the final fill step commences as described above.

The second tumbling pattern used in step 134 may be different than the first tumbling pattern used in step 128. Since treating chemistry from the single use dispenser 30 is dispensed by the dispensing nozzle 46 in step 126, and treating chemistry from the bulk dispenser 32 is sprayed by the spray nozzle 68 in step 132, the coverage patterns 108, 110, of the treating chemistry may be significantly different, as shown in FIG. 2. This can result in a significantly different wetting of the laundry load with the treating chemistry, depending on whether the single use or bulk dispenser 30, 32 is used. In order to optimize the treatment of the laundry load, the first and second tumbling patterns may be configured in accordance with the coverage patterns 108, 110 of the nozzles 46, 68, respectively, to ensure proper distribution of treating chemistry and water throughout the laundry load, regardless of which nozzle 46, 68 is used to dispense the treating chemistry. Alternatively, the first and second tumbling patterns used in steps 128, 134 may be substantially the same.

The first tumbling pattern used in step 128 may be configured to support the "pick-up" of water accumulated in the sump 90 by the laundry load, and to further distribute the water and treating chemistry throughout the laundry load. Accordingly, the first tumbling pattern can include longer rotation phases relative to shorter non-rotation phases. In one non-limiting example, the motor 24 can be active 13 seconds, and then inactive for three seconds.

The second tumbling pattern used in step 134 can be configured to maximize the exposure of the laundry load to the spray from the spray nozzle 68. Accordingly, the second tumbling pattern can alternate between a pattern of longer rotation phases relative to shorter non-rotation phases, which will expose a portion of the laundry load to the spray to create a wetted portion, and a pattern of shorter rotation phases relative to longer non-rotation phases, which will allow the wetted portion of the laundry load to move toward the bottom and rear of the treating chamber 20, thereby exposing a different portion of the laundry load to the spray before switching back to the pattern. The speed at which the motor 24 operates, i.e. revolutions per minute (RPM), can also be varied. In one non-limiting example, the motor 24 can first follow a pattern of being active for 30 seconds and inactive for two seconds at 50 RPM, and then can switch to another pattern of being active for eight seconds and inactive for eight seconds at 40 RPM.

The clothes washer 10 and method 120 of the invention provide separate flow paths for the application of treating chemistry from the single use and bulk dispensers 30, 32. When a clothes washer 10 is provided with both a single use and bulk dispensers, the clothes washer 10 must decide where to dispense treating chemistry from. As described above, the clothes washer 10 and method 120 of the invention utilizes a first flow path for applying treating chemistry from the single use dispenser 30, and a second flow path for applying treating chemistry from the bulk dispenser 32. However, in either case, the treating chamber 20 is initially filled via the second flow path, which includes a spray nozzle 68. The sensor 70 may be used to determine the presence of treating chemistry within at least one of the single use dispenser 30 and the bulk dispenser 32, and, based on this determination, supply water to the flow path associated with the dispenser which contains treating chemistry. The treating chemistry can be dispensed for the purpose of treating a load of laundry within the treating chamber 20, or for purpose of treating the clothes washer 10 itself. In the latter case, the treating chamber 20 typically does not contain a load of laundry; rather, the treating chemistry can be applied to the drum 18 and tub 16.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims. For example, the sequence of steps depicted in each method described herein is for illustrative purposes only, and is not meant to limit the disclosed methods in any way as it is understood that the steps may proceed in a different logical order or additional or intervening steps may be included without detracting from the invention.

What is claimed is:

1. A laundry treating appliance configured to execute a cleaning cycle on an article, comprising:

a cabinet defining an interior;

a tub located within the interior;

a drum located within the tub and defining a treating chamber configured to receive the article for cleaning; and a dispensing system configured to dispense treating chemistry into the treating chamber, comprising:

a housing located within the interior of the cabinet;

multiple chambers located within the housing;

a single use dispenser configured to dispense a single dose of a first treating chemistry and comprising one of the chambers for receiving the single dose of treating chemistry;

a bulk dispenser configured to dispense multiple doses of a second treating chemistry and comprising a cartridge removably received within another one of the chambers and containing multiple doses of treating chemistry that are dispensed through an outlet in the cartridge;

a first water flow path passing through the housing and the one of the chambers and having a dispensing nozzle in fluid communication with the treating chamber; and a second water flow path comprising:

a conduit bypassing the housing and fluidly coupled to the cartridge outlet;

a pump to direct the second treating chemistry to the treating chamber;

a spray nozzle in fluid communication with the treating chamber; and an in-line mixing chamber comprising a first inlet in communication with the pump, a second inlet in communication with a source of water, and an outlet in communication with the spray nozzle, wherein the first water flow path is configured to direct the dose of treating chemistry dispensed from the single use dispenser into the treating chamber and the second water flow path is configured to spray the dose of treating chemistry dispensed from the bulk dispenser into the treating chamber.

2. The laundry treating appliance of claim 1 wherein the one of the chambers comprises a dispensing cup.

3. The laundry treating appliance of claim 1, further comprising a sensor for determining the presence of treating chemistry in one of the single use dispenser and the bulk dispenser.

4. The laundry treating appliance of claim 3 wherein the sensor is provided within the housing for determining the presence of the cartridge within the housing.

5. The laundry treating appliance of claim 3, further comprising a diverter valve coupled to the first water flow path and the second inlet of the in-line mixing chamber for selective fluid communication with one of the first and second water flow paths, wherein the position of the diverter valve is controlled based on the information from the sensor.

6. The laundry treating appliance of claim 1 wherein the first and second flow paths are in fluid communication with a source of water, and further comprising a diverter valve coupled between the source of water and the first water flow path and the second inlet of the in-line mixing chamber for selective fluid communication of one of the first and second water flow paths with the source of water.

7. The laundry treating appliance of claim 1 wherein the dispensing nozzle comprises a gravity-feed dispenser that is configured to direct a non-pressurized flow of treating chemistry into the treating chamber.

8. The laundry treating appliance of claim 7 wherein the gravity-feed dispenser comprises a conduit extending from the housing and terminating in the dispensing nozzle.

9. The laundry treating appliance of claim 8 wherein a portion of the housing underlies the one of the chambers.

10. The laundry treating appliance of claim 1 wherein the spray nozzle comprises a pressurized spray nozzle that is configured to direct a pressurized spray of treating chemistry into the treating chamber.

11. The laundry treating appliance of claim 1 wherein the housing comprises a drawer slidably coupled to the cabinet.

* * * * *